United States Patent [19]

Jedo

[11] 3,981,799

[45] Sept. 21, 1976

[54] BAUM JIG

[75] Inventor: Antoni Jedo, Gliwice, Poland

[73] Assignee: Centralny Osrodek Projektowokonstrukcyjny Maszyn Gorniczych "Komag", Gliwice, Poland

[22] Filed: May 29, 1975

[21] Appl. No.: 581,921

[30] Foreign Application Priority Data

May 30, 1974 Poland ..... 171533

[52] U.S. Cl. ..... 209/457; 209/491; 209/493; 209/496; 209/500

[51] Int. Cl.[2] ..... B03B 5/20

[58] Field of Search ..... 209/454–457, 209/500, 491, 493, 494, 496, 427

[56] References Cited

UNITED STATES PATENTS

| | | | |
|---|---|---|---|
| 987,179 | 3/1911 | Seltner | 209/457 |
| 1,317,941 | 10/1919 | Reap | 209/457 |
| 2,677,463 | 5/1954 | Bolhar et al. | 209/455 |
| 3,082,873 | 3/1963 | Bartelt | 209/496 X |
| 3,344,920 | 10/1967 | Mayer et al. | 209/457 |

FOREIGN PATENTS OR APPLICATIONS

| | | | |
|---|---|---|---|
| 1,189,481 | 3/1965 | Germany | 209/457 |
| 122,097 | 7/1958 | U.S.S.R. | 209/455 |
| 275,907 | 11/1970 | U.S.S.R. | 209/454 |

*Primary Examiner*—Frank W. Lutter
*Assistant Examiner*—Ralph J. Hill
*Attorney, Agent, or Firm*—Haseltine, Lake & Waters

[57] ABSTRACT

A Baum Jig for gravitational enrichment of minerals, particularly hard coal, in which a screen deck is transversely located to the axis of the jig. Air chambers are made of plates as cut-outs of a cylindrical surface. The axes of symmetry are deflected from the perpendicular by an angle of 5° to 15° in the direction of the mineral to be enriched. The chambers are provided with asymmetric guide vanes adjustable in the horizontal direction. The side walls of a water cistern possess at the height of the screen decks, horizontal off-sets outside the cistern. Spring-loaded protection plates are provided in the off-set supports. The lower edge of one wall of each chamber is shaped as a conduit of back water provided from the bottom with a deflectable arched diaphragm.

12 Claims, 7 Drawing Figures

BAUM JIG

Figure 1:
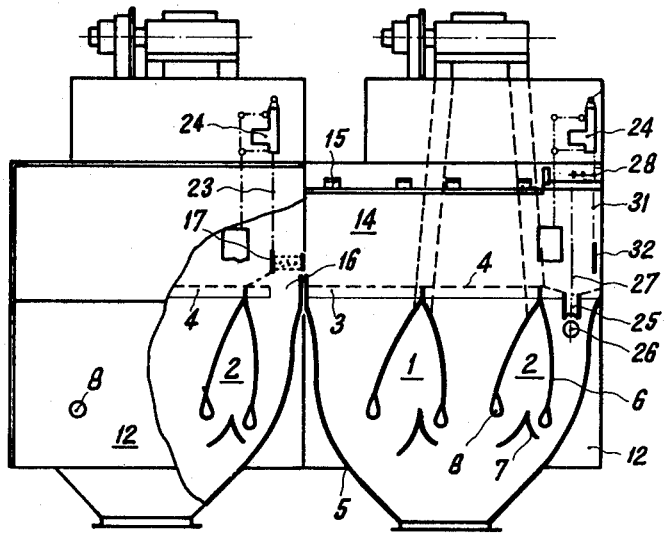

The invention relates to a baum jig with air chambers located beneath the screen deck designed for gravitational enrichment of minerals, particularly hard coal.

There are known jigs with wedge-shaped symmetrical air chambers with vertical axis Polish patent No. 34,081, German Federal patent No. 1,217,292, and with asymmetric chambers with arch axis USSR Patent No. 122097. In the hitherto known jigs the air chambers acting jointly with a given segment of the working bed have equal volumes, resulting in similar water pulsation conditions on the whole surface of the screen deck of the jig.

A change of parameters of water movement can be obtained within a limited range by changing the pressure or the amount of air supplied to the chambers, or the amount of back water supplied. Upon the conditions of water flow, particularly within the zone of the screen deck, some influence is also exerted by elements fixing the screen to the walls of the water cistern of the jig. In known solutions German Federal patent No. 1189481 they protrude into the inside of the water cistern, thus reducing the active width of the working bed.

The shape of elements closing the slot for the reception of heavy fraction from the bed of the jig made in the form of flat plates U.S. Pat. No. 3,344,920, or cutouts of a cylindrical surface is also influencing the conditions of the water flow, mainly near the segment of the screen deck.

The hitherto known jigs have in most cases individual design solutions adapted to the enrichment of minerals with properties being known in advance, and their production has a unit character. These are usually two-troughs jigs, in which the compressed-air reservoir mounted between the working troughs German Federal patent Nos. 1,189,481 and 1,193,891 makes their inseparable design element permanently joined with water cisterns of the jig.

Such a design solution complicates the production of jigs and provides difficulties in their selection for specific properties and amounts of minerals to be enriched, for new and modernized processing works.

In the jig in accordance with the present invention, the area of horizontal section and the volume of the air chambers acting jointly with a half of the screen deck adjoining the rear wall is greater than that of air chambers acting jointly with the half of the screen deck adjoining the front wall and, besides, the air chambers are deflected from the perpendicular by an angle of 5° to 15°, and have asymmetric guide vanes displaceable in a horizontal direction.

Different section areas and volumes of air chambers beneath the screen deck of the same area and a deflection from the perpendicular of all chambers and the application of asymmetric guide vanes ensures a greater jump, or greater accelerations of water on the segment of the screen deck, where the raw mixture of mineral is supplied, and a smaller jump or lower acceleration on the area of the screen deck near the receiver, while maintaining a uniform water jump throughout the entire width of the jig trough.

In a chamber of greater area, at the same air pressure, greater resultant forces are obtaned than with a chamber of smaller section.

Asymmetric guide vanes adjustable in a horizontal direction located beneath the air chambers permit increasing variation of the amounts and parameters of water flowing through particular segments of the screen deck.

The walls of air chambers and the rear and front walls forming between channels for pulsating water are made of cylindrical sections of the same radius, resulting in uniformity of flow near the wall and lower pressure losses.

For better conditions of water flow through the layer of the mineral, the lower edge of one wall of the air chambers is shaped in a form of a conduit of back water and is provided with a deflectable arched diaphragm suspended inside the conduit on ties. This diaphragm opens automatically in the first phase of the pulsation cycle insuring the supply on considerable amount of back water within a short time. Besides, the side walls of the water cistern are provided in the upper portion at the height of the working bed with outward offsets in which supports for the screen deck are located. The deck is pressed on to the supports by spring-loaded protecting plates, which are held in a state of elastic buckling by means of keyseat clamps. This prevents the falling out of keys and displacements of the screen deck under the action of pulsating water.

In the jig in accordance with the present invention, two design solutions of receivers have been applied. In one solution the reception slot is provided at the top with a control diaphragm in the form of an open trough with sieve bottom whereby the portion of the diaphragm separating a layer of the mineral in the bed of the jig is made in a form of perforated plates, on which at one side the stiffening-guiding ribs are fastened. The perforated plates are suspended side by side, being supported on a bolt fixed to the wall of said trough of the diaphragm. The whole diaphragm is suspended by means of ties to the drive, which establishes its position depending on the amount of heavy fraction on the screen deck nearby the receiver. The plates separating the layer in the bed of the jig have a freedom of individual deflection upwards, which permits carrying away large mineral grains or other impurities, e.g. iron scrap. In the above mentioned trough of the diaphragm a layer of natural or artificial mineral is permanently kept, which prevents fine grains of the light fraction from flowing out to the receiver due to the pulsating movement of water.

In the second compartment of the jig the reception slot is provided from the bottom with a control diaphragm in the form of a cylinder element suspended freely on ties passing through the reception slot. The ties are suspended from the double-arm drive lever, which is supported deflectably on a shaft mounted in bearings. On the other end of said lever a flat control value is suspended on ties. The lever system being set in motion by the drive rod permits simultaneously the lowering of the control diaphragm with cylinder element and the lifting of the flat control valve.

The shape of these elements of the receiver and their suspension and displacement favours a smooth carrying away of the heavy fraction and prevents the diaphragm and the control valve from jamming during operation.

The jig in accordance with the present invention, consists of a number of water cisterns arranged side by side in a series-parallel system. The side walls of the particular water cisterns are made in the form of rectangular plates, whose rims are shaped in the form of horizontal and vertical flanges making together with said walls the support means of the water cistern on which the compressed-air reservoir is mounted.

Two or more water cisterns placed side by side in parallel are connected together along the line of contact of horizontal and vertical flanges, which together with side walls make the central bearing element of water cisterns, simultaneously forming an additional compressed air reservoir.

On the central bearing element the reservoirs of compressed air are mounted. In conditions, when the air demand for enrichment of minerals is relatively low and when the work parameters of the parallel water cisterns are similar, on the reservoirs of compressed air a distribution attachment with one pulsating valve is located. These attachements are provided with control diaphragms for the purpose of adaptation of the supply of compressed air according to operating conditions of the jigs.

A differentiation in the jig in accordance with the present invention, of the size of chambers, their inclination and also the kind of fixing of the screen deck and the shaping of receivers ensures advantageous conditions for the pulsating water flow with changing quantity of the jump along the axis of the jig and simultaneous reduction of hydraulic losses. An automatically operating system of back water supply enables its effective utilization in the process of distribution and reduces the consumption of circulating water. A limitation of disturbances in water movement and the possibility of a selection in particular segments of the quantity of its jump, depending on the properties of the given material, and also a wide range of the regulation of water flow, ensures obtaining accurate separation of coal of different mineralogical composition on the jig of small length.

In comparison with known jigs, a great engineering and design similarity enables a prefabrication of parts in a wide range, thus shortening production time.

The applied designs of receivers ensure an accurate separation of light and heavy fractions while at the same time their work reliability without jamming is guaranteed.

The jig can be used for the enrichment of a wide range of grain classes, and it also may be operated even in cases when feed material impurities in the form of iron scrap occur.

Figure 6:
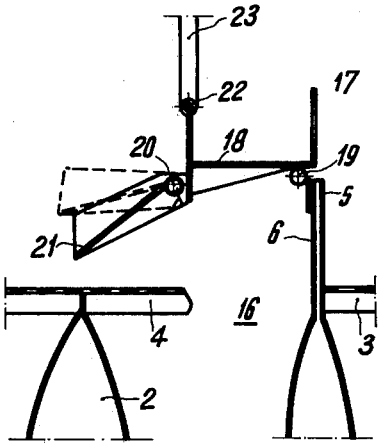
Figure 7:
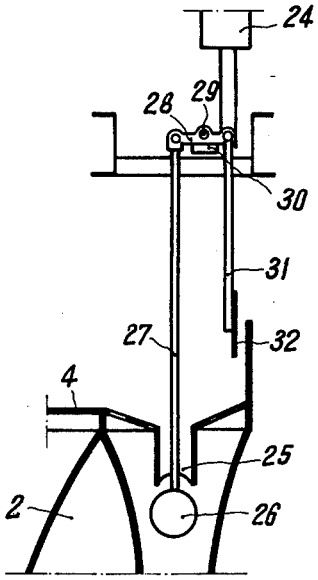
Figure 2:
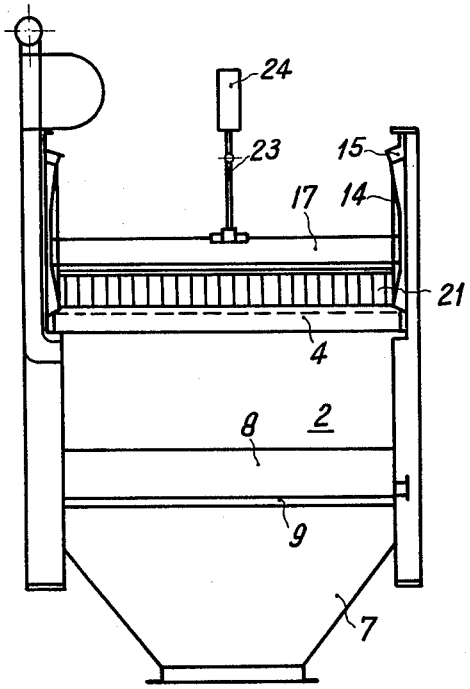
Figure 8:
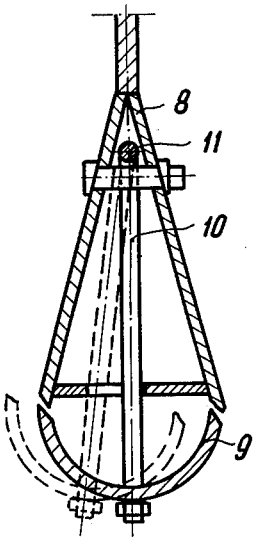
Figure 9:
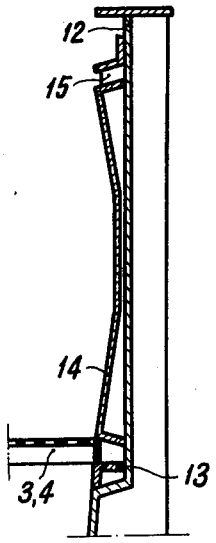
Figure 3:
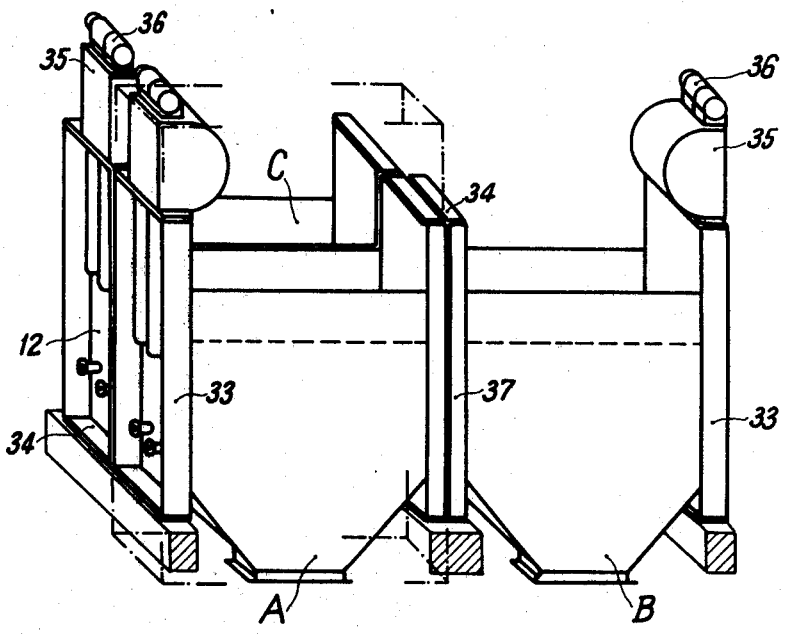
Figure 4:
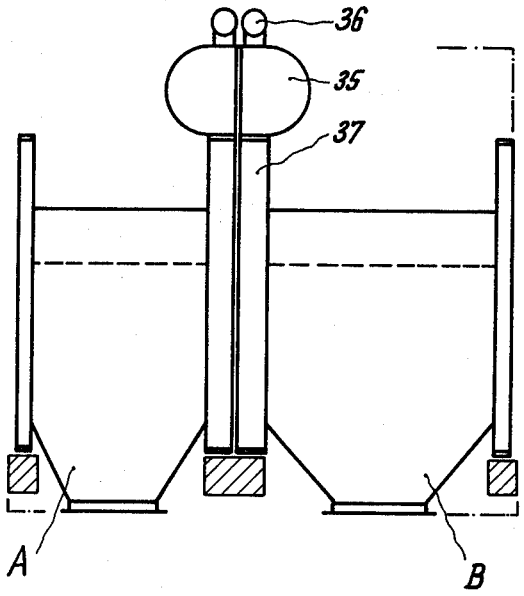
Figure 5:
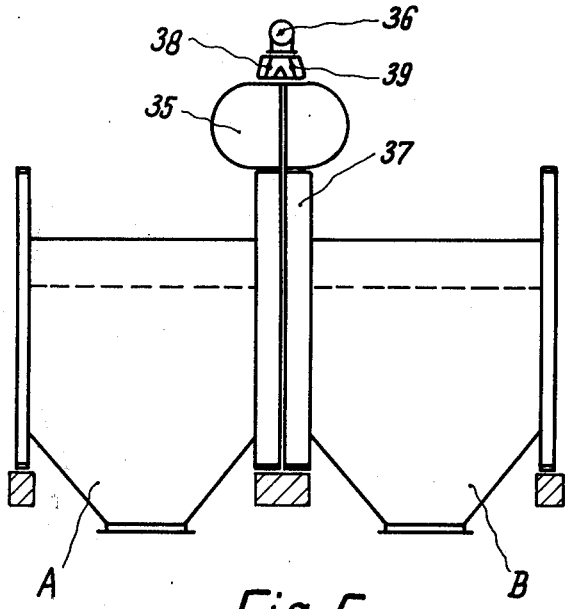

The subject of the invention is illustrated on some examples of design in the drawings enclosed, in which particular figures show:

FIG. 1 — side view and partial vertical section along the axis of the jig,

FIG. 2 — vertical section of the jig in a plane perpendicular to its axis,

FIG. 3 — two-trough jig in axonometric projection,

FIG. 4 — vertical view on the rear wall of the two-trough jig with air reservoir mounted on the bearing structure of water cistern, FIG. 5 — vertical view on the rear wall of the jig provided with a single row of valves, FIG. 6—vertical section with a plane parallel to the axis of the jig through receiver with control diaphragm of the reception slot from top, FIG. 7—vertical section with a plane parallel to the axis of the jig through receiver with control diaphragm of the reception slot, from bottom, FIG. 8—vertical section with a plane parallel to the axis of the jig through the conduit that supplies back water, FIG. 9—vertical section with a plane perpendicular to the axis of the jig through side wall and the fixing portion of the screen deck.

The jig designed for enrichment of small-size coal with medium enrichment capacity is provided with air chambers 1 and 2, mounted beneath the screen decks 3 and 4 forming the bed of the jig transversely to its axis.

In this jig the air chamber 1 acting jointly with a half of the screen deck 3 adjoining the rear wall 5 of the water cistern has the surface of the hole and particular horizontal sections and volumes of a greater size than the appropriate sections and volumes of the chamber 2, acting jointly with the half of the screen deck 4 adjoining the front wall 6 of the water cistern.

The chmbers 1 and 2 are symmetrical chambers with axes deflected from the perpendicular by an angle of 5° to 15° in the direction of transportation of the mineral, FIG. 1 which provides conditions for better transportation on the screen surface. Beneath the chambers 1 and 2 asymmetric guide vanes 7 adjustable in the horizontal direction are located.

The walls of air chambers 1 and 2 and the arched portions of the front wall 6 and the rear wall 5 are made of plates, being cylindrical sections of the same radius.

Between the rear wall 5 and the air chamber 1 and between the chambers 1 and 2, and between the chamber 2 and the front wall 6, channels are formed for pulsating water having a section of hydraulic diffusers with small pressure losses.

The back water is supplied to the jig by the conduit 8 of a triangular section, located on the lower edge of one wall of air chambers 1 and 2. From the bottom the conduit 8 is provided with a deflectable arched diaphragm 9 suspended on ties 10 and bolt 11.

Under the action of the flowing water and of the pressure difference, in the hole of the air chamber and in the water channel an automatic deflection of the arched diaphragm 9 takes place. Through the slot formed back water flows in, which supports the ascending movement of back water in the channel. Upon the termination of the ascending movement of water through the screen deck, i.e., when the speed of water drops to zero, and when water flows back to the air chamber, the diaphragm is, as a rule, closed.

In the side wall 12 of the water cistern at the height of the working bed offsets are made, in which supports 13 for the screen deck 3 and 4 pressed on by spring-loaded protection plates 14 with key clamps are located. The protection plates 14 are cut-outs of a polyhedral surface with bent-off edges. These plates under the influence of key clamps 15 are subject to elastic buckling in the direction of side wall 12 of the water cistern.

FIG. 6 shows, in an enlargement, the vertical section through the receiver of heavy elements, in which the reception slot 16 is provided from top with control diaphragm 17 in the form of an open channel with sieve bottom 18. On one side this channel is supported deflectably through the bolt 19 on the upper edge of the front wall 6, and on the other side perforated plates 21 are suspended on the bolt 20 side by side. On the side of each plate 21 a tightening and guiding rib is located, which prevents the plates from jamming. This is essential when during lowering of the diaphragm suspended through bolt 22 and tie 23 to the drive 24, larger mineral grains or iron pieces occur beneath it.

In the said chanel trough in the bottom sieve 18 a layer of natural or artificial mineral is provided, which prevents fine grains of light fraction from flowing off to the reception slot 16. This diaphragm is applied to the jig in cases when in the coal to be jogged impurities in the form of iron scrap are present, or when jogging large-size coal.

During the processing of small coal without impurities in a form of larger iron pieces or grains of heavy minerals, the receiver with a reception slot from the bottom is used FIG. 7. The slot 25 is provided at the bottom with a control diaphragm 26 in the form of a cylindrical element. This diaphragm is suspended freely through ties 27 passing through slot 25 to the two-arm drive lever 28.

The freely suspended diaphragm 26 and ties 27 passing through the slot 25 due to a displacement and smooth strokes under the action of pulsating water, prevent the slots from being jammed by grains of the heavy fraction of the mineral being enriched their removal.

On the mentioned two-arm drive lever 28 which is suppoted on the shaft 20 mounted in bearings 30 the following are suspended: on one end the diaphragm 26, and on the other end a flat vertical control valve 32 passed through ties 31. When the diaphragm 26 is being lowered and opens the reception slot 25, the valve 32 is lifted simultaneously, as a result of the outflow of the product from the bed of the jig is reduced.

The jig consists of a number of water cisterns A,B,C set up side by side in a series-parallel system FIG. 3. The side walls 12 of particular water cisterns are provided with horizontal and vertical stiffening flanges 33 and 34 which constitute the bearing structure for water cisterns and the supporting structure for reservoirs of compressed air 36.

The particular cisterns are located side by side in a parallel system FIGS. 4 and 5 and are connected along the line of contact of flanges 33 and 34. In consequence, between the cisterns a central bearing element 37 is formed, which besides exercising the bearing function for water cisterns and reservoirs 35, fulfills the role of an additional reservoir of compressed air for water cisterns adjoining each other.

Each water cistern of the jig possesses its own control system of compressed air FIG. 4. In conditions when air demand is relatively low and a material with only slightly differring properties is supplied to the parallel troughs, a distribution attachment with one pulsating valve 36 is mounted on the reservoirs of compressed air 35. The attachment 38 is provided with control diaphragms 39, whose purpose is the adaptation of the supply to operating conditions in particular water cisterns.

I claim:

1. A baum jig with a screen deck comprising, in combination, a number of water cisterns each having a feed end and a discharge end and arranged in a series-paralleled system with symmetrical air chambers opened at the bottom and located beneath the screen deck transversely to the axis of the jig, said symmetrical air chambers comprising plates as sections of a cylindrical surface, the symmetry axes of said air chambers being deflected from the perpendicular by an angle of 5° to 15° toward said feed end, said chambers having asymmetric guide vanes displaceable in a horizontal direction.

2. A jig, according to claim 1, including rear walls with arc portions and front walls of said water cisterns, the walls of said air chambers, the arc portions of said rear walls and said front walls of said water cisterns forming channels for pulsating water comprised of plates as sections of a cylindrical surface of the same radius.

3. A jig, according to claim 1, wherein the volume of the air chambers cooperating with a half of the screen deck adjoining the rear wall of the water cistern is greater than that of the air chambers cooperating with the half of the screen deck adjoining the front wall of water cistern.

4. A jig, according to claim 1, wherein the lower edge of one wall of each air chamber is formed as a conduit for back water and having a deflectable arched diaphragm.

5. A jig, according to the claim 4, including ties on bolts fixed rotatably in the upper portion of the conduit for back water for supporting said diaphragm.

6. A jig according to claim 1, including reception slot means at the top of a control diaphragm and comprising an open trough with bottom sieve a bolt on the upper edge of said front wall for supporting one side of the sieve deflectably, and perforated plates suspended on the other side of the sieve, and a drive whereby, the whole diaphragm is suspended to the drive through bolts and ties.

7. A jig, according to claim 1, including reception slot means at the bottom of a conrol diaphragm and comprising a cylindrical element suspended freely, ties passing through said slot means, a two-arm drive lever supported deflectably on a shaft mounted in bearings and receiving said ties, and a flat control valve suspended freely on ties at the other end of said lever.

8. A baum jig with a screen deck comprising, in combination, a number of water cisterns, each having a feed end and a discharge end and arranged in a series-paralleled system with symmetrical air chambers opened at the bottom and located beneath the screen deck transversely to the axis of the jig, said symmetrical air chambers comprising plates as sections of a cylindrical surface, the symmetry axes of said air chambers being deflected from the perpendicular by an angle of 5° to 15° toward said feed end, said chambers having asymmetric guide vanes displaceable in a horizontal direction, side walls of the water cistern comprised of rectangular plates with edges shaped in the form of horizontal and vertical flanges forming together with said walls a support of the water cistern, said water cisterns being mounted on said support.

9. A jig, according to claim 8, including joined support means of two cisterns arranged in parallel side by side and forming a central support and being an additional reservoir of compressed air.

10. A jig, according to claim 9, including a distribution attachment with control diaphragms mounted on the reservoirs of compressed air, and a pulsation valve on said attachment.

11. A jig, according to claim 8, wherein the side walls of the water cistern have at the height of the screen decks horizontal offset supports for the screen decks.

12. A jig, according to claim 11, including spring-loaded protection plates with key clamps in the offset supports for the screen deck.

* * * * *